United States Patent [19]

Langner

[11] 4,265,445

[45] May 5, 1981

[54] PHOTOCOPIER COLLATOR

[76] Inventor: Fred R. Langner, 48 Hillcrest La., Williamsport, Pa. 17701

[21] Appl. No.: 46,673

[22] Filed: Jun. 8, 1979

[51] Int. Cl.[3] ..... B65H 29/60; B65H 31/24

[52] U.S. Cl. ..... 271/296; 271/224; 271/302; 414/51

[58] Field of Search ..... 271/296, 302, 303, 224, 271/223, 297, 298, 287, 292, 208, 311; 270/58; 193/31 R, 31 A; 414/51

[56] References Cited

U.S. PATENT DOCUMENTS

| | | | |
|---|---|---|---|
| 2,076,391 | 4/1937 | Whitehead | 271/296 |
| 3,315,957 | 4/1967 | Mazzio et al. | 271/296 |
| 3,516,654 | 6/1970 | Mestre | 271/296 X |
| 3,578,859 | 5/1971 | Stillings | 271/311 X |
| 3,754,647 | 8/1973 | DiFrank et al. | 271/303 X |
| 3,774,906 | 11/1973 | Fagan et al. | 271/297 X |
| 3,937,459 | 2/1976 | Lawrence | 271/297 |

OTHER PUBLICATIONS

"Caro Stacker", M. E. Bothun et al., *IBM Technical Disclosure Bulletin,* vol. 14, No. 3, Aug. 1971, pp. 827–828.

*Primary Examiner*—Bruce H. Stoner, Jr.

*Attorney, Agent, or Firm*—Birch, Stewart, Kolasch & Birch

[57] ABSTRACT

The present invention is directed to a photocopier collator wherein a movable paper chute is disposed between the discharge slot of a photocopy machine and the entry point of a plurality of bins mounted adjacent thereto. The movable paper chute is designed to receive copies from the photocopy machine and to direct them successively into one of the bins. The chute is successively diverted to each of the predetermined number of bins by means of a pulse from the photocopy machine which indicates that a copy has been produced and discharged to a bin. The pulse actuates a solenoid which controls a cam latch thereby releasing a follower, which is attached to the movable paper chute. Actuation of the solenoid successively lowers the paper chute to divert successive sheets of photocopies to each of the predetermined number of bins. After the pulse from the photocopy machine has actuated the solenoid, the latch is pulled away from the solenoid by means of a spring. After the predetermined number of photocopies have been diverted to each of the successive bins, a second solenoid returns the movable paper chute to repeat the cycle.

11 Claims, 7 Drawing Figures

PHOTOCOPIER COLLATOR

BACKGROUND OF THE INVENTION

1. Field of the Invention

The present invention is directed to a collator for a modern, electrostatic photocopy machine.

2. Description of the Prior Art

Various collating machines are available in the prior art for separating successive copies of a document into groups. Normally, the collating machines are rather complicated and expensive. For example, the selective tray sheet sorting machine disclosed by Lawrence in U.S. Pat. No. 4,026,540, is directed to a collating machine which is rather bulky and extremely complicated.

Regensteiner, U.S. Pat. No. 615,636, discloses an anti-offsetting apparatus for a printing press. This device is designed to divert printed sheets to one of the trays 32. Again, this device is rather bulky and awkward and does not lend itself to be readily combined in combination with a modern, electrostatic photocopy machine.

Whitehead, U.S. Pat. No. 2,076,391, discloses a sheet segregating apparatus whereby copies from a duplicating machine are diverted to one of several trays. A guide 31 is selectively lowered by one of the cams 28, 29 or 30. Similarly, in a second embodiment, the guide 51 is selectively lowered to divert a copy to one of the trays 52–55 by means of cams, only one cam 67 being shown.

The apparatus disclosed by Whitehead requires a mechanical connection between the duplicating machine and the cam which operates either the guide 31 or the guide 51. Although this mechanical connection is readily adapted for use in combination with a mimeograph duplicating machine, it is not readily adapted for use in combination with a modern, electrostatic photocopy machine.

SUMMARY AND OBJECTS OF THE INVENTION

It is a primary object of the present invention to provide a photocopier collator which is relatively simple in construction and easily adapted to be used in combination with a modern electrostatic photocopy machine.

Another object of the present invention is to provide a photocopier collator which is relatively compact in size and is designed to collate a limited number of photocopies.

A further object of the present invention is to provide a photocopier collator including a movable paper chute which is selectively lowered to divert a photocopy to each of the selected bins upon actuation by a solenoid electrically connected to the photocopy machine.

A still further object of the present invention is to provide a photocopier collator wherein the movable chute is actuated by a solenoid connected to a cam latch which engages the movable paper chute to selectively lower the chute thereby diverting the photocopies to successive bins.

A still further obejct of the present invention is to provide a second solenoid which is electrically connected to the photocopy machine whereby the movable paper chute is returned to its initial position after the predetermined number of photocopies have been diverted to each of the successive bins.

These and other objects of the present invention are accomplished by providing a photocopier collator which includes a plurality of bins mounted adjacent to the discharge slot of a photocopy machine. A movable paper chute is positioned between the discharge slot and the entry point of the plurality of bins. The movable paper chute is designed to receive copies from the photocopy machine and successively divert them into each of the plurality of bins. The movable paper chute is selectively diverted by means of a cam latch operatively connected to the movable chute and connected to a solenoid which is electrically connected to the photocopy machine to successively lower the movable chute thereby diverting photocopies to the various plurality of bins. After the predetermined number of photocopies have been diverted to each of the successive bins, a second solenoid returns the movable paper chute to repeat the cycle.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
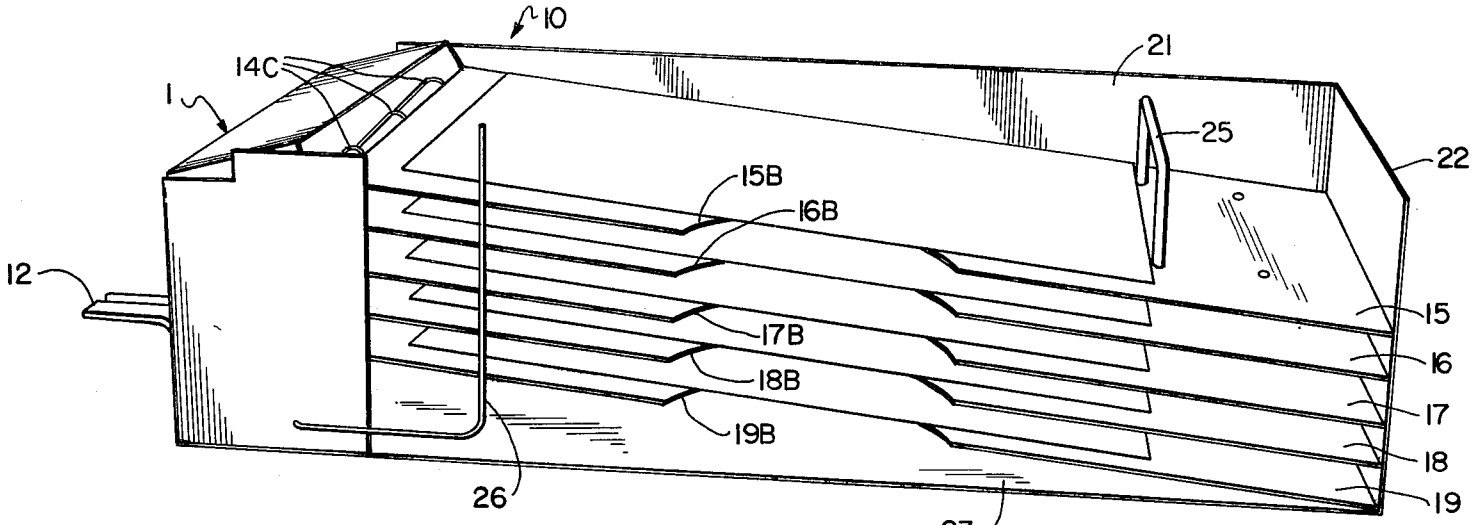
FIG. 1 is a perspective front view illustrating the photocopier collator according to the present invention.
Figure 2:
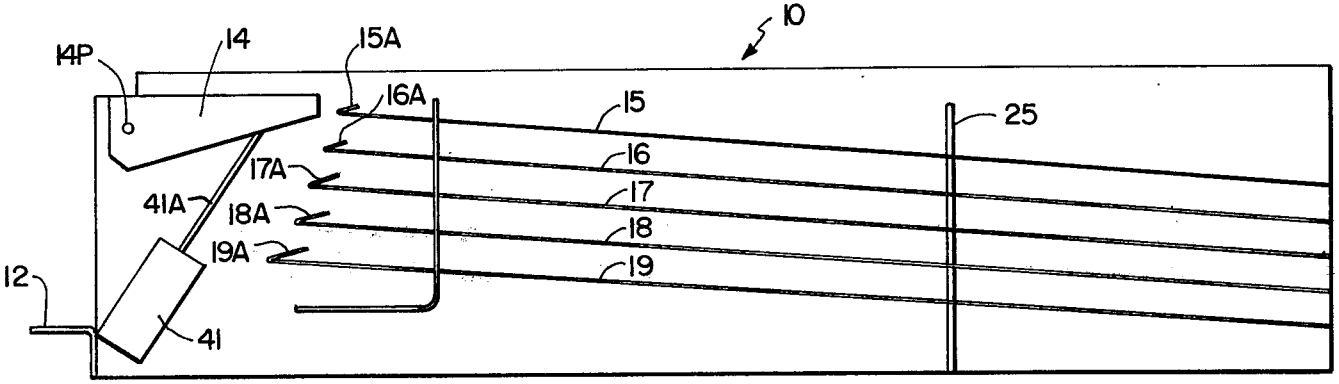
FIG. 2 is a cross-sectional view illustrating the movable paper chute positioned adjacent to a plurality of bins according to the present invention.
Figure 3:
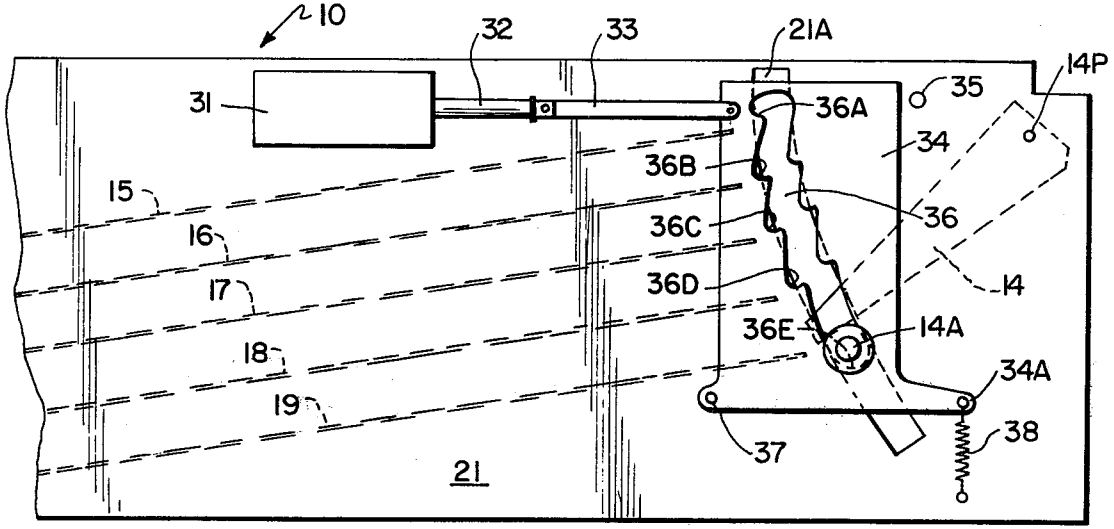
FIG. 3 is a side view illustrating the cam latch and solenoid as viewed from the back of the photocopier collator according to the present invention.

As illustrated in FIGS. 1–3, the photocopier collator according to the present invention is generally indicated by character 10. The collator is readily attached to a modern, electrostatic photocopier machine by means of a pair of flanges 12. The flanges 12 are designed to be adjustable so as to accurately position the receiving end of the movable paper chute 14 directly adjacent to the discharge slot of an electrostatic photocopy machine.

In a preferred embodiment of the present invention, five bins 15–19 are provided at the discharge side of the movable paper chute 14. Photocopies from the electrostatic photocopy machine are successively diverted by means of the movable paper chute 14 to each of the predetermined number of bins 15–19. The bins 15–19 are positioned within a housing which includes a backwall 21, an endwall 22 and a bottomwall 23. One end and a front side of the housing are opened. The opened end is adapted to be connected to a modern, electrostatic photocopy machine. The front side of the housing provides access to the collated photocopies positioned within the bins 15–19. In addition, semi-circular openings 15B–19B are provided along the open front side to facilitate the removal of photocopies from the bins 15–19.

As illustrated in the drawings, the bins 15–19 are inclined relative to the bottomwall 23 of the housing. In this manner, photocopies discharged from the electrostatic photocopy machine are readily received and slide under the influence of gravity within the bins.

As illustrated in FIG. 3, positioned on the backwall 21 of the housing is a solenoid 31. The solenoid includes an operating arm 32 which is connected by means of a link 33 to a cam latch 34. The cam latch is pivotally mounted about a pivot point 37 on the backwall and its movement is limited by means of a stop 35.

The cam latch 34 includes an opening 36 which defines a tortuous path. A follower 14A attached to the movable paper chute 14 is adapted to be positioned within the opening 36. In addition, the opening 36 includes four flanges 36A–36D which accurately position the follower 14A and the chute 14 to divert a photocopy from the electrostatic photocopy machine to one of the bins 15–19. When the follower 14A is positioned on the flange 36A a photocopy will be diverted to bin 15. Similarly, when the follower 14A is positioned on the flange 36B a photocopy will be diverted to the bin 16. In a similar fashion, the flange 36C corresponds with bin 17 and the flange 36D corresponds with bin 18. The bottom 36E of the opening 36 positions the follower 14A so as to divert a photocopy to the last bin 19.

The cam latch includes an arm 34A which is connected to a spring 38 for returning the cam latch 34 to its normally substantially vertical position. After the solenoid 31 has moved the cam latch 34 to the left, as illustrated in FIG. 3, to lower the follower 14A from one flange surface to the next adjacent flange surface, the spring 38 returns the cam latch 34 to its normally substantially vertical position so that the follower 14A is accurately positioned on the next adjacent flange surface. It is important to note that FIG. 3 is a view of the photocopier collator according to the present invention as viewed from the back of the device. Therefore, the modern, electrostatic photocopy machine would be positioned to the right of the photocopy collator as illustrated in FIG. 3.

The backwall 21 of the housing includes an arcuate slot 21A. The arcuate slot 21A together with the opening 36 in the cam latch 34 act as a guide for the follower 14A of the movable chute 14. As illustrated in FIGS. 2 and 3, the movable paper chute 14 is pivoted about the point 14P. The arcuate slot 21A corresponds to an arc made by follower 14A as the movable paper chute 14 pivots about the point 14P.

As illustrated in FIG. 2, a second solenoid 41 includes an operating arm 41A which is connected to the movable paper chute 14. The second solenoid 41 is provided for returning the movable paper chute from the bottom 36E of the opening 36 back to its original, initial position adjacent to bin 15. In this manner, after a predetermined number of photocopies have been diverted to the predetermined number of bins 15–19, the movable paper chute 14 is returned to its initial position to begin diverting a second photocopy for collating together with the first photocopy already deposited in the predetermined number of bins. The second solenoid 41 raises the chute so that the follower 14A moves upwardly to the top flange 36A. Thereafter, the photocopier collator is ready to receive and divert a second photocopy to the bin 15 and thereafter the solenoid 31 will be actuated to move the cam latch 34 to the left, as illustrated in FIG. 3, to enable the follower 14A of the movable paper chute 14 to be dropped from the flange 36A to the flange 36B. The spring 38 returns the cam latch 34 to its normally substantially vertical position after the solenoid 31 has been actuated.

As illustrated in FIGS. 1 and 2, each of the bins 15–19 includes a paper adapter 25 which is positioned adjacent the lower end of the bins. The paper adapter is removable so that larger photocopies may be received within the bins. Therefore, the bins 15–19 may be adjusted to receive photocopies which are 8½" by 11" and photocopies which are 8½" by 14". Similarly, other suitable standard size photocopies may be received within the bins 15–19 by positioning the paper adapter 25 at a suitable predetermined location within mating opening along the bins.

At the entry point of each bin 15–19, deflectors 15A–19A are provided to prevent the photocopy received within the particular bin from being bounced back onto the movable paper chute 14. In addition, the deflectors 15A–19A aid in the stacking of the photocopies received in the bins. However, the deflectors 15A–19A, although preferred, may be deleted from the photocopier collator without detracting from the overall performance.

Figure 4:
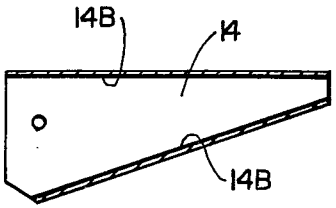
FIG. 4 illustrates a cross-sectional view of a second embodiment of the movable paper chute.

The movable paper chute 14 may include guide wires 14C which are positioned on the upper and lower surfaces of the movable paper chute. In a preferred embodiment of the present invention, three guide wires 14C may be positioned on the lower surface of the movable paper chute and three guide wires 14C may be positioned on the upper surface of the movable paper chute 14. The guide wires 14C reduce the friction between the photocopy and the movable paper chute and thus enhance the operation of the photocopier collator. In a second embodiment of the present invention, as illustrated in FIG. 4, the movable paper chute 14 may be lined with a surface of Teflon 14B. The Teflon 14B also reduces the friction between the photocopy and the movable paper chute so as to enhance the performance of the photocopier collator.

As illustrated in FIGS. 1 and 2, a paper retainer 26 is provided adjacent the open side of the photocopier collator. The paper retainer ensures that the photocopies positioned within the bins 15–19 are retained therein during the operation of the photocopier collator. The paper retainer 26 is designed to pivot downwardly so as to enable an individual to remove the collated copies from the bins 15–19. Again, the paper retainer 26, although preferred, may be deleted from the photocopier collator without detracting from the overall performance.

Figure 6:
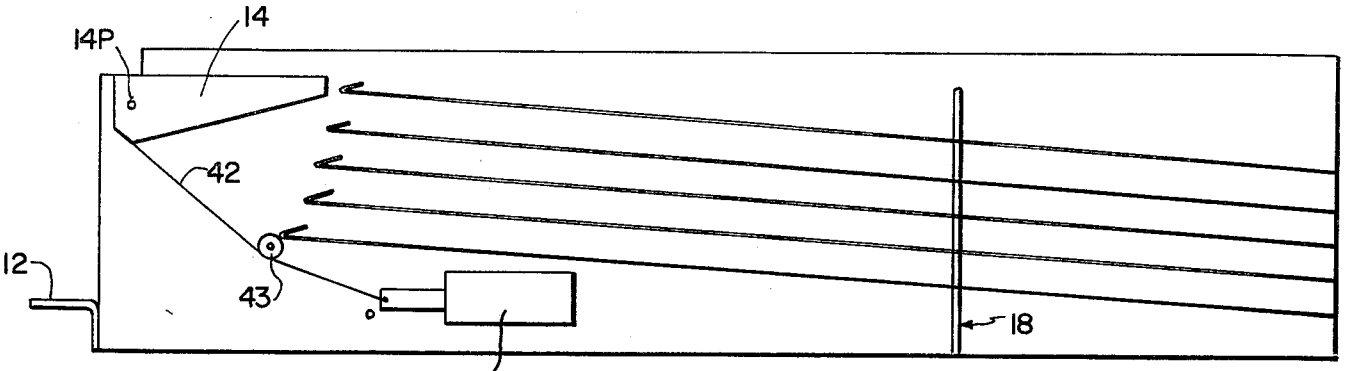
FIG. 6 is a cross-sectional view of a second embodiment of a photocopier collator according to the present invention.

In another embodiment of the present invention, as illustrated in FIG. 6, the solenoid 41 is connected to the movable paper chute 14 by means of a cable 42. The cable 42 is guided along its path by means of a guide pulley 43. After the movable paper chute 14 has diverted photocopies to each of the bins 15–19 the solenoid 41 would be actuated to pull the cable 42 thereby rotating the movable paper chute 14 about its pivot point 14P to return the chute to its original initial position adjacent the first bin 15. The solenoid 41 would then be deactuated and would permit the solenoid 31 to operate the cam latch 34 thereby returning the movable paper chute 14 downwardly adjacent to each of the bins 16–19. After a photocopy has been diverted to the predetermined number of bins, the solenoid 41 would again be actuated to pull the cable 42 thereby returning the movable paper chute 14 to its original initial position.

Figure 5:
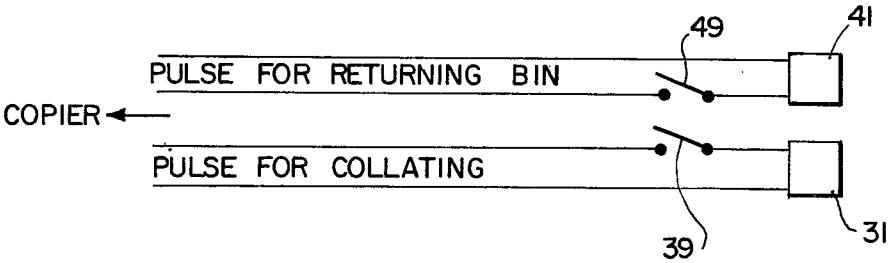
FIG. 5 is a schematic illustration of the electrical connection for the photocopier collator according to the present invention.

FIG. 5 illustrates the electrical circuit for controlling the solenoids 31 and 41. Initially, the switches 39 and 49 are moved to the closed position thereby actuating the photocopier collator of the present invention. The switch 39 connects the solenoid 31 to the electrostatic photocopy machine. As a photocopy is discharged from the electrostatic photocopy machine an electrical pulse is received from the photocopy machine thereby actuating the solenoid 31 to enable the lowering of the follower 14A. Each time a pulse is received from the photocopy machine indicating that a photocopy is being discharged therefrom, the solenoid 31 is actuated to thereby move the follower 14A successively downwardly. Similarly, the switch 49 connects the solenoid 41 to the quantity control mechanism for the electrostatic photocopy machine. An individual operating the electrostatic photocopy machine would initially set the machine to process a predetermined number of copies. The switch 49 would connect the solenoid 41 to the mechanism for determining the quantity of copies desired. After the predetermined number of quantities are discharged from the photocopy machine, a pulse would be transmitted through the switch 49 to the solenoid 41 thereby actuating the solenoid 41 to return the movable paper chute 14 to its original position.

Figure 7:
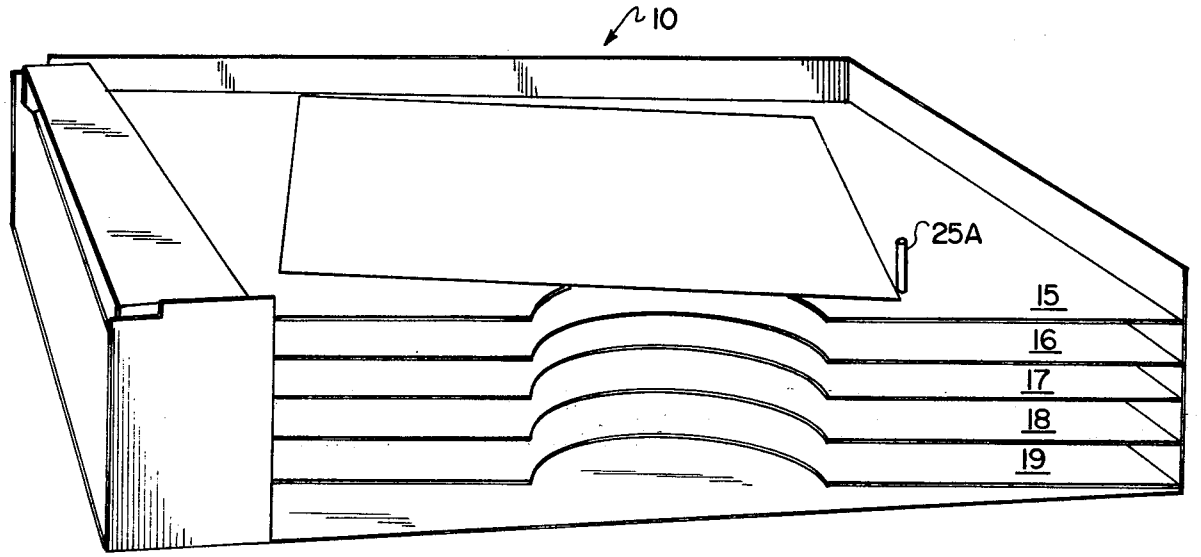
FIG. 7 is a perspective view of another embodiment of a paper adapter for the plurality of bins according to the present invention.

FIG. 7 illustrates another embodiment of a paper adapter 25A. In this embodiment of the present invention, the paper adapter 25A consists of a single pin positioned adjacent to the lower portion of the bins 15–19 so that the photocopies received in each of the bins 15–19 are rotated about the paper adapter 25A. Rotating the received photocopies about the paper adapter 25A forces the photocopy inside the bin at a slight angle. The paper adapter 25A is movable along the bins 15–19 so as to adjust the bins to receive various sizes of photocopies.

It is important to note that although the preferred embodiment of the present invention includes five bins 15–19 that additional or fewer bins may be utilized without departing from the intent of the present invention.

The invention being thus described, it will be obvious that the same may be varied in many ways. Such variations are not to be regarded as a departure from the spirit and scope of the invention, and all such modification as would be obvious to one skilled in the art are intended to be included within the scope of the following claims.

I claim:

1. A collator adapted for use with an electrostatic photocopy machine comprising:

a plurality of bins mounted within a housing;

a movable chute operatively positioned to receive photocopies from a discharge slot of said electrostatic photocopy machine and divert said photocopies to each of said plurality of bins, said movable chute being selectively pivoted from an initial position;

means for selectively pivoting said movable chute including an electrical connection adapted to receive a first pulse from said electrostatic photocopy machine indicating that a photocopy has been discharged therefrom, said pulse actuating said means for selectively pivoting said movable chute to lower said movable chute for diverting photocopies to each successive bin, said means for selectively pivoting said movable chute including a first solenoid actuated by said first pulse and operatively connected to a cam latch, said cam latch including a tortuous path with flanges for guiding a follower connected to said movable chute to lower said movable chute with each actuation of said first solenoid; and means for returning said movable chute including an electrical connection adapted to receive a second pulse from said electrostatic photocopy machine indicating the completion of a predetermined number of copies, said second pulse actuating said means for returning said movable chute to return said chute to its initial position for diverting a photocopy to a first bin of said plurality of bins.

2. A collator according to claim 1, wherein said cam latch is pivotally mounted on said housing and is spring biased to a normally substantially vertical position.

3. A collator according to claim 2, wherein said follower connected to said movable chute projects through an arcuate slot in said housing, said arcuate slot and said tortuous path of said cam latch acting together to retain said follower and selectively lower said movable chute with each actuation of said first solenoid.

4. A collator according to claim 3, wherein said movable chute is pivotally mounted on said housing and said arcuate slot defines an arc of a circle wherein the radius is defined as the distance between said follower and a pivot point of said movable chute.

5. A collator according to claim 1, wherein said means for returning said movable chute includes a second solenoid actuated by said second pulse and operatively connected to said movable chute.

6. A collator according to claim 5, wherein said second solenoid is operatively connected to a cable attached to said movable chute for returning said movable chute to its initial position.

7. A collator according to claim 1, wherein said movable chute includes guide wires positioned interiorly thereof to reduce the friction of photocopies received from said electrostatic photocopy machine.

8. A collator according to claim 1, wherein said movable chute includes a Teflon surface positioned interiorly thereof to reduce the friction of photocopies received from said electrostatic photocopy machine.

9. A collator according to claim 1, wherein a paper adapter is selectively, movably positioned along said plurality of bins to adjust said bins to receive various lengths of photocopies.

10. A collator according to claim 9, wherein said paper adapter is a single pin vertically mounted and disposed adjacent to a front side of said plurality of bins whereby said photocopies received within each of said plurality of bins are rotated against a back side of said bins.

11. A collator according to claim 1, and further including a paper retainer rotatably mounted adjacent to an open front side of said plurality of bins for retaining said photocopies within said bins when disposed in an upright position and rotatable to a lowered position to provide access to said plurality of bins.

* * * * *